US006776240B2

(12) United States Patent
Kenison et al.

(10) Patent No.: US 6,776,240 B2
(45) Date of Patent: Aug. 17, 2004

(54) DOWNHOLE VALVE

(75) Inventors: Michael H. Kenison, Missouri City, TX (US); Michael L. Smith, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1 day.

(21) Appl. No.: 10/208,115

(22) Filed: Jul. 30, 2002

(65) Prior Publication Data

US 2004/0020636 A1 Feb. 5, 2004

(51) Int. Cl.[7] ..... E21B 34/06; F16K 11/02

(52) U.S. Cl. ..... 166/330; 166/328; 166/332.2; 166/66.6; 166/66.4; 137/596.2; 137/865; 137/870

(58) Field of Search ..... 166/66.4, 66.6, 166/332.2, 330, 318, 326, 328, 373; 175/40, 50; 340/854.6, 853.3, 853.1; 73/152.01, 152.02; 137/865, 870, 862, 596.18, 596.2

(56) References Cited

U.S. PATENT DOCUMENTS

| | | | | |
|---|---|---|---|---|
| 3,687,163 A | * | 8/1972 | Nickels | 137/625.11 |
| 3,837,360 A | * | 9/1974 | Bubula | 137/625.46 |
| 3,992,597 A | * | 11/1976 | Hannula | 200/61.39 |
| 4,023,167 A | | 5/1977 | Wahlstrom | |
| 4,049,017 A | * | 9/1977 | Jones | 137/540 |
| 4,372,392 A | * | 2/1983 | Barrington et al. | 166/373 |
| 4,466,456 A | * | 8/1984 | Hansen | 137/596.2 |
| 4,572,293 A | | 2/1986 | Wilson et al. | |
| 4,578,675 A | | 3/1986 | MacLeod | |
| 4,630,044 A | | 12/1986 | Polzer | |
| 4,656,463 A | | 4/1987 | Anders et al. | |
| 4,684,946 A | | 8/1987 | Issenmann | |
| 4,698,631 A | * | 10/1987 | Kelly et al. | 340/853.1 |
| 4,763,520 A | | 8/1988 | Titchener et al. | |
| 4,827,395 A | | 5/1989 | Anders et al. | |
| 4,968,978 A | | 11/1990 | Stolarczyk | |
| 4,980,682 A | | 12/1990 | Klein et al. | |
| 4,992,787 A | | 2/1991 | Helm | |
| 5,144,298 A | | 9/1992 | Henneuse | |
| 5,160,925 A | | 11/1992 | Dailey et al. | |
| 5,189,415 A | | 2/1993 | Shimada et al. | |

(List continued on next page.)

FOREIGN PATENT DOCUMENTS

| | | |
|---|---|---|
| EP | 0 273 379 A2 | 7/1988 |
| EP | 0 539 240 A3 | 4/1993 |
| EP | 0 539 240 A2 | 4/1993 |
| EP | 0 651 132 A2 | 5/1995 |
| EP | 0 651 132 A3 | 5/1995 |
| EP | 0 730 083 A2 | 9/1996 |
| EP | 0 730 083 A3 | 8/1998 |
| WO | WO 00/60780 | 10/2000 |
| WO | WO 00/73625 | 12/2000 |
| WO | WO 01/92675 A2 | 12/2001 |

*Primary Examiner*—David Bagnell
*Assistant Examiner*—Shane Bomar
(74) *Attorney, Agent, or Firm*—Wayne I. Kanak; Robin Nava; Brigitte Echols

(57) ABSTRACT

A valve for downhole well service, having a rotary indexer carrying an elastically-loaded valve element on a valve seat surface in a flow passage, the valve element adapted to obstruct one or more flow passages in the valve seat surface when aligned therewith. The valve may additionally, or alternatively, comprise an elastically-loaded valve element mounted in one or more flow passages in the valve seat surface, this valve element adapted to obstruct the flow passage in which it is installed when urged into contact with the valve seat surface. When a valve element is mounted in one or more of the flow passages in the valve seat, the indexer comprises a protrusion positioned to engage such valve element and force it out of contact with the valve seat surface. The valve may be actuated by command from the surface by sending telemetry elements to a downhole telemetry data detector.

21 Claims, 5 Drawing Sheets

U.S. PATENT DOCUMENTS 5,268,683 A 12/1993 Stolarczyk
5,279,366 A 1/1994 Scholes
5,307,838 A * 5/1994 d'Agostino et al. ... 137/625.11
5,350,018 A 9/1994 Sorem et al.
5,361,383 A 11/1994 Chang et al.
5,363,094 A 11/1994 Staron et al.
5,394,141 A 2/1995 Soulier
5,457,447 A 10/1995 Ghaem et al.
5,467,083 A 11/1995 McDonald et al.
5,495,237 A 2/1996 Yuasa et al.
5,497,140 A 3/1996 Tuttle
5,512,889 A 4/1996 Fletcher
5,576,703 A 11/1996 MacLeod et al.
5,585,790 A 12/1996 Luling
5,623,965 A * 4/1997 Snider et al. ..... 137/596.2
5,626,192 A 5/1997 Connell et al.
5,680,459 A 10/1997 Hook et al.
5,682,143 A 10/1997 Brady et al.
5,720,345 A 2/1998 Price et al.
5,784,004 A 7/1998 Esfahani et al.
5,818,352 A 10/1998 McClure
5,904,210 A 5/1999 Stump et al.
5,945,923 A 8/1999 Soulier
5,959,548 A 9/1999 Smith
5,995,449 A 11/1999 Green et al.
5,996,687 A * 12/1999 Pringle et al. ..... 166/66.6
6,025,780 A 2/2000 Bowers et al.
6,026,911 A 2/2000 Angle et al.
6,041,857 A * 3/2000 Carmody et al. ..... 166/66.4
6,070,608 A * 6/2000 Pringle ..... 137/155
6,078,259 A 6/2000 Brady et al.
6,138,754 A * 10/2000 Veneruso et al. ..... 166/250.03
6,150,954 A 11/2000 Smith
6,241,015 B1 * 6/2001 Pringle et al. ..... 166/66.4
6,241,028 B1 * 6/2001 Bijleveld et al. ..... 175/40
6,289,911 B1 * 9/2001 Majkovic ..... 137/1
6,333,699 B1 12/2001 Zierolf
6,343,649 B1 2/2002 Beck et al.
6,359,569 B2 3/2002 Beck et al.
6,408,943 B1 6/2002 Schultz et al.
6,443,228 B1 * 9/2002 Aronstam et al. ..... 166/250.11
2002/0088620 A1 7/2002 Lerche et al.
2003/0098799 A1 * 5/2003 Zimmerman ..... 340/854.6

* cited by examiner

DOWNHOLE VALVE

CROSS-REFERENCE TO RELATED APPLICATIONS

This application is related to U.S. patent application Ser. No. 10/208,462 entitled "Universal Downhole Tool Control Apparatus and Methods", filed Jul. 30, 2002.

BACKGROUND OF THE INVENTION

1. Field of the Invention

The present invention generally concerns downhole valves that are particularly useful in petroleum production wells for accomplishing a wide variety of control functions. More particularly, the present invention concerns a downhole valve that is operable without necessitating the presence of control cables, conductors in the well, or mechanical manipulators, and which may be made responsive to predetermined instructions to perform predetermined well control functions.

2. Description of the Related Art

Historically, one of the limiting factors of downhole valves has been the need to power and/or operate such valves from the surface necessitating the presence of control cables, conductors in the well, or mechanical manipulators. An example of a tool string that may be deployed in a well, including a typical downhole valve, is described in U.S. Pat. No. 5,350,018, which is incorporated herein by reference. The tool string of the '018 patent communicates with the surface by means of an electrical conductor cable deployed in the coiled tubing by which the tool string is run into the well. Certain downhole valves are designed to be operated using push/pull techniques requiring highly skilled and experienced operators. Such techniques often produce inconsistent results. Hence, a downhole valve that is powered and operated without the use of a conductor from the surface or mechanical manipulation is highly desirable.

BRIEF SUMMARY OF THE INVENTION

The present invention provides a downhole valve system that is operable from the surface without necessitating that the well or downhole tool conveyance mechanism of the valve be equipped with electrical power and control cables extending from the surface to the downhole valve, and without the use of complex and inherently unreliable mechanical shifting or push/pull techniques requiring downhole movement controlled remotely from the surface.

The valve of the present invention, identified as an indexing valve, directs internal fluid flow through one or more ports. The valve utilizes a motor-driven rotary indexer to actuate sealing elements to open and close ports in the valve body. The valve motor is powered by a downhole battery. The downhole battery may be mounted in a side pocket mandrel and may be changed by means of a kick-over tool.

The specification also describes how a wireless telemetry system may be used to control the downhole valve of the present invention remotely from the surface. The downhole valve may be controlled by any or all of multiple types of shaped internal telemetry devices, (for example, balls, darts, or objects of other suitable geometry), sent or dropped downhole, carrying information to a downhole sensor to cause the valve to actuate. These shaped internal telemetry devices, regardless of their geometry, may be classified as Type I, II, or III, or combinations of Types I, II, and III.

A Type I internal telemetry device has an identification number or other designation corresponding to a predetermined event. Once a downhole sensor receives or detects the device identification number or code, a pre-programmed computer will perform a series of logical analyses and then actuate the downhole valve to a predetermined position.

A Type II internal telemetry device has a reprogrammable memory that may be programmed at the surface with an instruction set which, when detected by a downhole sensor, causes the downhole valve to actuate according to the instruction set. The downhole device may also write information to the Type II tag for return to surface.

A Type III internal telemetry device has one or more embedded sensors. This type of device can combine two or more commands together. For example, a Type III device may have a water sensor embedded therein. After landing downhole, if water is detected, the Type III device issues a command corresponding to a downhole actuation event, for example closing of the downhole valve.

BRIEF DESCRIPTION OF THE DRAWINGS

So that the manner in which the above recited features, advantages and objects of the present invention are attained may be understood in detail, a more particular description of the invention, briefly summarized above, may be had by reference to the embodiments thereof illustrated in the appended drawings, which drawings are incorporated as a part hereof.

It is to be noted, however, that the appended drawings illustrate only typical embodiments of the invention and are therefore not to be considered limiting of its scope, for the invention may admit to other equally effective embodiments.

In the Drawings:

FIG. 1 is a sectional view of a downhole tool having a tool chassis within which is located a sensor, such as a radio-frequency "RF" antenna and with protrusions within the flow passage of the tool chassis for controlled internal telemetry element movement through the RF antenna to permit accurate internal telemetry element sensing;

FIG. 1A is a sectional view taken along line 1A—1A of FIG. 1;

FIG. 1B is a logic diagram illustrating internal telemetry of a tagged object in a well to a reader or antenna and processing of the signal output of the reader or antenna along with data from downhole sensors to actuate a mechanical device and to cause pressure signaling to the surface for confirmation of completion of the instructed activity of the mechanical device;

FIG. 1C is a sectional view of a ball type internal telemetry element having a releasable ballast to permit descent thereof in a conveyance passage fluid and after release of the ballast permit ascent thereof in a conveyance passage fluid for retrieval without fluid flow;

FIG. 2 is a diagrammatic illustration, shown in section, depicting an indexing valve according to the present invention;

FIG. 2A is an enlarged view of the indexer and spring-urged valve mechanism of FIG. 2, showing the construction thereof in detail;

FIG. 2B is a sectional view taken along line 2B—2B of FIG. 2 showing the outlet arrangement of the motorized, spring-urged valve mechanism of FIG. 2;

FIG. 2C is a bottom view of the indexer of FIG. 2, taken along line 2C—2C, showing the arrangement of the spring-urged, ball type check valve elements thereof;

Figure 3:
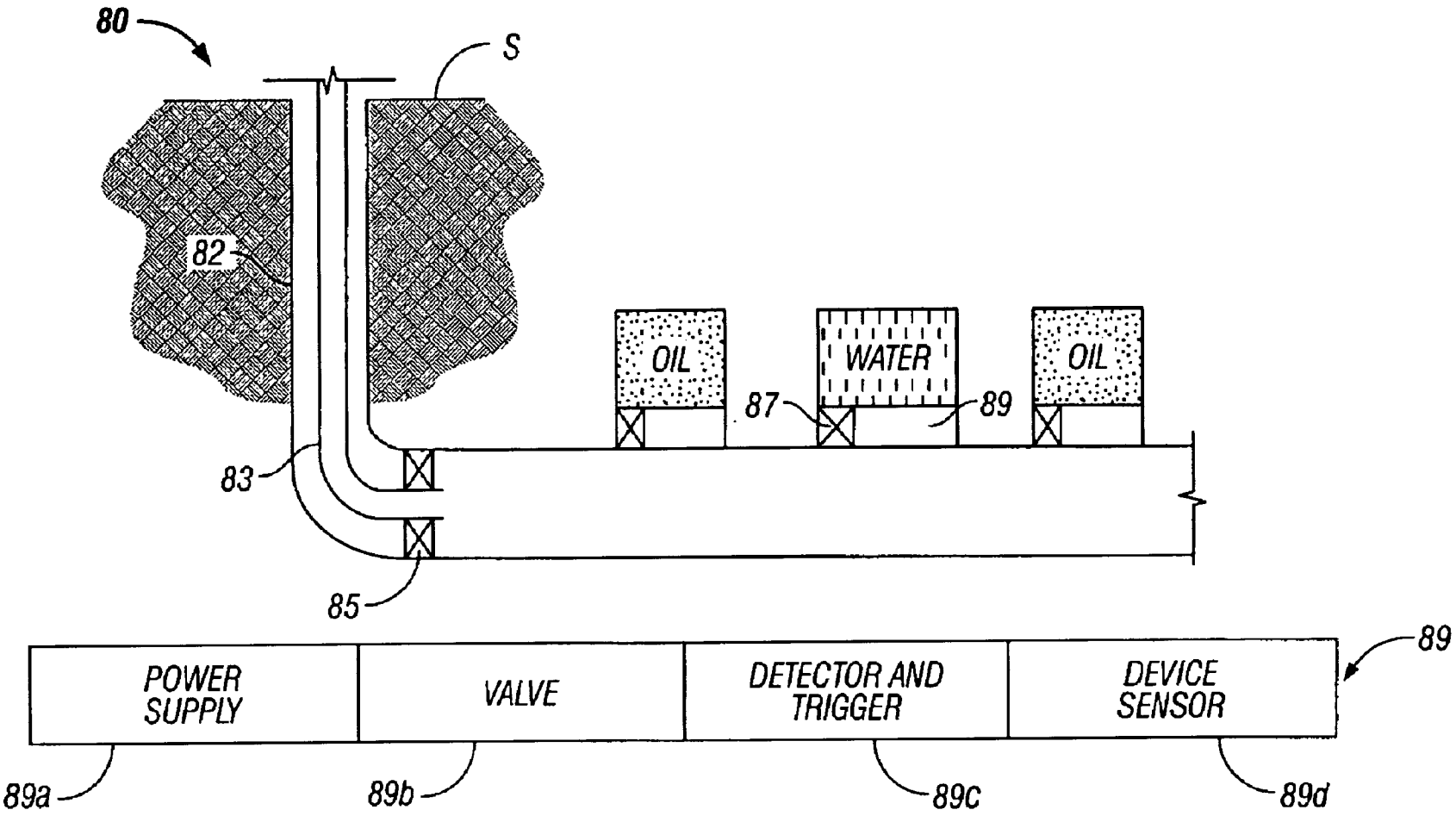
Figure 4:
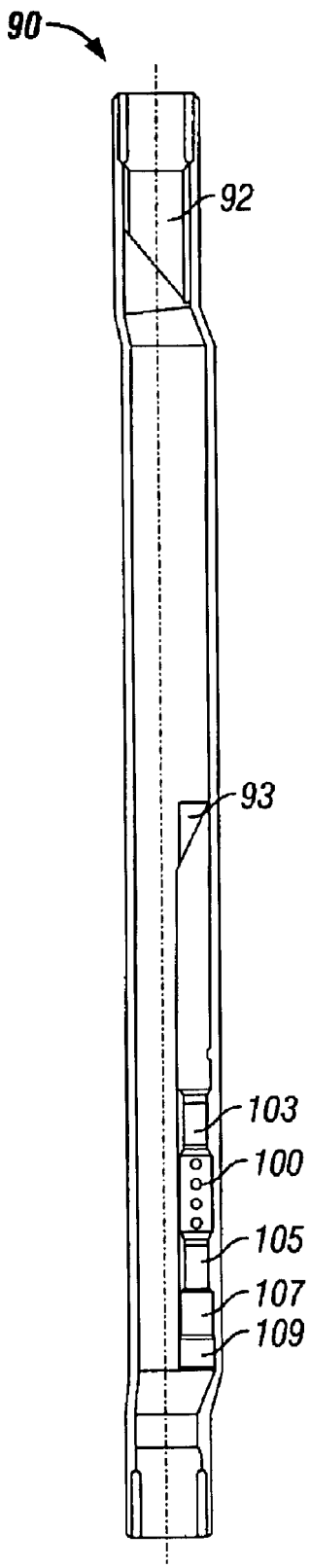
Figure 5:
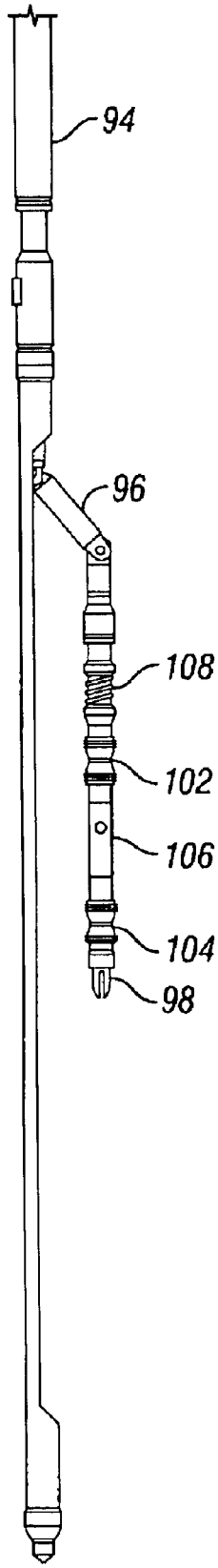

FIG. 3 is a schematic illustration of a well system producing from a plurality of zones with production from each zone controlled by a valve of the present invention and illustrating the need for valve closure at one of the production zones due to the detection of water and the use of the present invention for accomplishing closure of a selected well production zone; and FIGS. 4–9 are longitudinal sectional views illustrating the use of a side pocket mandrel in a production string of a well and a kick-over tool for positioning a battery within or retrieving a battery from a battery pocket of the side pocket mandrel, thus illustrating battery interchangeability for electrically energized well control systems using the technology of the present invention.

DETAILED DESCRIPTION OF THE INVENTION

From the standpoint of explanation of the details and scope of the present invention, data telemetry systems are discussed in connection with terms such as data transmission "balls", "drop balls", "darts", "objects", "elements", "devices" and "fluid". It is to be understood that these terms identify objects or elements that are conveyed from the surface through well tubing to a downhole tool or apparatus having the capability to "read" data programmed in or carried by the objects or elements and to carry out instructions defined by the data. The objects or elements also have the capability of transmitting one or more instructions depending upon characteristics that are present in the downhole tool or apparatus or the downhole environment within which the downhole tool or apparatus resides. It should also be understood that the term "fluid" is also intended to be encompassed within the term "element" for purposes of providing an understanding of the spirit and scope of the present invention. Additionally, for purposes of the present invention, the term "drop" is intended to mean an object that is caused to descend through well tubing from the surface to downhole apparatus by any suitable means, such as by gravity descent, by transporting the object in a fluid stream, and by also returning the object to the surface if appropriate to the telemetry involved.

Internal Telemetry

An internal telemetry system for data telemetry in a well consists of at least two basic components. First, there must be provided a conveyance device that is used to carry information from the surface to the tool. This conveyance device may be a specially-shaped object that is pumped through the coil of a coiled tubing, or may comprise a fluid of predetermined character representing an identification or instruction or both. The fluid is detected as it flows through a wire coil or other detector. The second required component for internal telemetry is a device in the downhole tool that is capable of receiving and interpreting the information that is transported from the surface by the conveyance device.

Data conveyance elements may be described as "tagged drop balls" generally meaning that telemetry elements that have identity and instruction tags of a number of acceptable forms are dropped into or moved into well tubing at the surface and are allowed to or caused to descend through the conveyance passage of the well tubing to a downhole tool or other apparatus where their identity is confirmed and their instructions are detected and processed to yield instruction signals that are used to carry out designated downhole tool operations.

The identification and instructions of the telemetry elements may take any of a number of other forms that are practical for internal well telemetry as explained in this specification. The telemetry element may also take the form of a fluid having a particular detectable physical or chemical characteristic or characteristics that represent instructions for desired downhole activities. Thus, the discussion of telemetry elements in the form of balls is intended as merely illustrative of one embodiment of the present invention. However, telemetry elements in the form of balls are presently considered preferable, especially when coiled tubing is utilized, for the reason that small balls can be easily transported through the typically small flow passage of the coiled tubing and can be readily conveyed through deviated or horizonal wellbores or multilateral branches to various downhole tools and equipment that have communication with the tubing.

Figure 1:
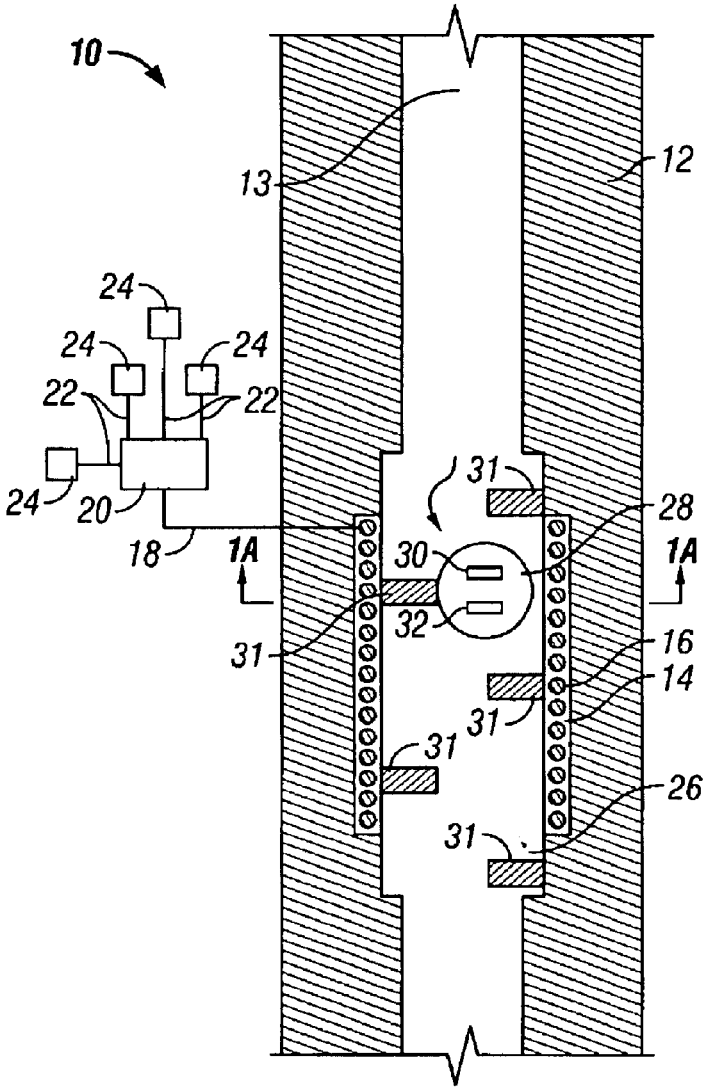
Figure 1A:
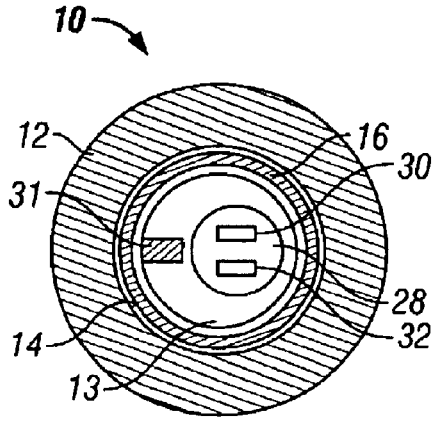

Referring now to the drawings and first to FIGS. 1 and 1A, there is shown an internal telemetry universal fluid control system, generally at 10, having a tool chassis 12 defining an internal flow passage 13 that is in communication with the flow passage of well tubing. The present invention has particular application to coiled tubing, though it is not restricted solely to use in connection with coiled tubing. Thus, the tool chassis 12 is adapted for connection with coiled tubing or other well tubing as desired. The tool chassis 12 defines an internal receptacle 14 having a detector 16 located therein that, as shown in FIGS. 1 and 1A, may take the form of a radio frequency (RF) antenna. The detector 16 may have any number of different characteristics and signal detection and response, depending on the character of the signal being conveyed. For example, the detector 16 may be a magnetic signal detector having the capability to detect telemetry elements having one or more magnetic tags representing identification codes and instruction codes.

The detector 16, shown as an RF antenna in FIG. 1, is shown schematically to have its input/output conductor 18 coupled with an electronic processor circuit 20 which receives and processes identification recognition information received from the RF antenna or other detector 16 and also receives and processes instruction information that is received by the antenna. One or more activity conductors 22 are provided for communication with the processor circuit 20 and also communicate with one or more actuator elements 24 that accomplish specifically designated downhole functions.

The tool chassis 12 defines a detection chamber 26 within which the internal receptacle 14 and detector 16 are located. The detection chamber 26 is in communication with and forms a part of the flow passage 13 thus permitting the flow of fluid through the flow passage 13 of the chassis 12 and permitting movement of telemetry objects or elements through the tool chassis 12 as required for carrying out internal telemetry for accomplishing downhole activities in the well system.

Figure 1C:
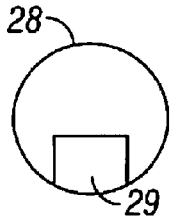
Figure 1B:
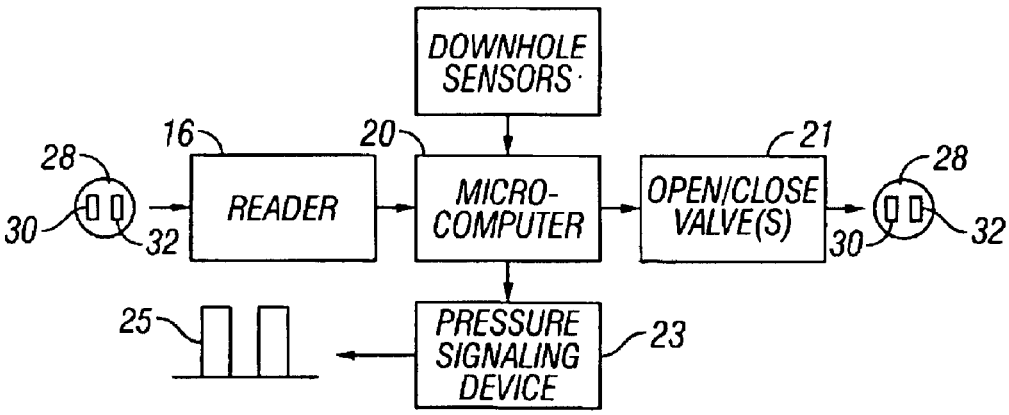

As shown in the logic diagram of FIG. 1B, internal telemetry is conducted within wells by moving telemetry elements 28, also referred to as data conveyance objects, from the surface through the tubing and through the tool chassis 12 in such manner that the identity information (ID) of the telemetry element and its instruction information may be detected, verified and processed by the detector or reader 16 and electronic processor circuit 20. In FIGS. 1, 1A and 1B the telemetry element 28 is shown as a small sphere or ball, but it is to be borne in mind that the telemetry elements 28 may have any of a number of geometric configurations without departing from the spirit and scope of the present invention. Each telemetry element, i.e., ball, 28 is provided with an identification 30 and with one or more instructions 32. The identification and instructions may be in the form of RF tags that are embedded within the telemetry element 28 or the identification and instruction tags or codes may have any of a number of different forms. The telemetry elements 28 may have "read only" capability or may have "read/write" capability for communication with downhole equipment or for acquisition of downhole well data before being returned to the surface where the acquired data may be recovered for data processing by surface equipment. For example, the read/write capable telemetry element or ball 28 may be used as a permanent plug to periodically retrieve downhole well data such as pressure and temperature or to otherwise monitor well integrity and to predict the plug's life or to perform some remedy if necessary. If in the form of a ball or other small object, the telemetry element 28 may be dropped or pumped downhole and may be pumped uphole to the surface if downloading of its data is deemed important. In one form, to be discussed below, the telemetry element 28 may have the form of a side pocket tool that is positioned within the pocket of a side pocket mandrel. Such a tool may be run and retrieved by wireline or by any other suitable means.

As shown in FIG. 1C, a telemetry element 28, which is shown in the form of a ball, but which may have other desirable forms, in addition to the attributes discussed above in connection with FIGS. 1, 1A, and 1B, may also include a ballast 29 which is releasable from the ball in the downhole environment. For example, the ballast 29 may be secured by a cement material that dissolves in the conveyance fluid after a predetermined period of exposure or melts after a time due to the temperature at the depth of the downhole tool. When the ballast 29 is released, the specific gravity of the telemetry ball 28 changes and permits the ball to ascend thorough the conveyance fluid to the surface for recovery. The ball 28, with or without the ballast, may be pumped through the conveyance passage to the surface if desired.

Especially when coiled tubing is utilized for fluid control operations in wells, the fluid typically flowing through the coiled tubing will tend to be quite turbulent and will tend to have high velocity. Thus, it may be appropriate for the velocity of movement of a telemetry element to be slowed or temporarily rendered static when it is in the immediate vicinity of the antenna or other detector. One method for slowing the velocity and rotation of the tagged drop ball telemetry element 28 within the detection chamber 26 of the tool chassis 12 is shown in FIG. 1. Internal protrusions 31, shown in FIGS. 1 and 1A, serve to change the direction of motion of the drop ball 28 from purely axial movement to a combination of axial and radial movement, thus delaying or slowing transit of the drop ball 28 through the detection chamber 26 of the tool chassis 12. These repeated changes in direction result in a reduced overall velocity, which permits the telemetry element 28 to remain in reading proximity with the detector or antenna 16 for a sufficient period of time for the tag or tags to be accurately read as the telemetry element 28 passes through the detection chamber 26. Furthermore, FIG. 1A shows that a substantial fluid flow area remains around the drop ball 28. This feature helps prevent an excessive pressure drop across the ball that would tend to increase the drop ball velocity through the antenna of the detection chamber 26. The protrusions 31 may be of rigid or flexible character, their presence being for altering the path of movement of the drop ball 28 through the detection chamber 26 and thus delay the transit of the ball through the detection chamber sufficiently for the embedded data of the ball to be sensed and the data verified and processed. The protrusions may be designed to "catch" the telemetry element at a predetermined range of fluid flow velocity and restrain its movement within the detection chamber, while the fluid is permitted to flow around the telemetry element. At a higher fluid flow velocity, especially if the internal protrusions are of flexible nature, the telemetry element can be released from the grasp of the protrusions and continue movement along with the fluid flowing through the tubing.

Referring now specifically to the logic diagram of FIG. 1B, a telemetry element 28 which is shown in the form of a ball, has embedded identification and instruction tags 30 and 32 and is shown being moved into a reader 16, which may be an RF antenna, to yield an output signal which is fed to a microcomputer 20. It should be noted that the identification and instruction tags 30 and 32 may comprise a read-only tag with only an identification number, or a read/write tag containing a unique identification number and an instruction set. Downhole condition signals, such as pressure and temperature, from downhole sensors are also fed to the microcomputer 20 for processing along with the instruction signals from the reader 16. After signal processing, the microcomputer 20 provides output signals in the form of instructions which are fed to an apparatus, such as a valve and valve actuator assembly 21 of the present invention, for opening or closing the valve according to the output instructions. When movement of the mechanical device, i.e., valve, has been completed, the microcomputer 20 may also provide an output signal to a pressure signaling device 23 which develops fluid pulse telemetry 25 to the surface to thus enable confirmation of successful completion of the instructed activity. After the instructed activity has been completed, the telemetry element 28, typically of small dimension and expendable, may simply be released into the wellbore. If desired, the telemetry element 28 may be destroyed within the well and reduced to "well debris" for ultimate disposal. However, if the telemetry element 28 has read/write capability, it may be returned to the surface with well data recorded and may be further processed for downloading the well data to a surface computer.

For a telemetry element to carry information from the surface to a downhole tool, it must have an intelligence capability that is recognizable by a detector of a downhole tool or equipment. Each data conveyance element must, in its simplest form, possess some unique characteristic that can be identified by the tool and cause the tool to accomplish a designated function or operation. Even this basic functionality would allow an operator to send a data conveyance element having at least one distinguishing characteristic (e.g. identification number) corresponding to a preprogrammed response from the downhole tool. For example, upon receiving a data conveyance element having an identification and having pressure or temperature instructions or both, the tool's data microprocessor, after having confirmed the identity of the data conveyance element, would, in response to its instructions, take a pressure or temperature measurement and record its value. Alternatively, the intelligence capability of the telemetry element may be in the form of instruction data that is recognized by a detector of the downhole tool and evokes a predetermined response.

Radio Frequency Tags

Passive radio frequency (RF) tags provide a simple, efficient, and low cost method for sending information from the surface to a downhole tool. These tags are extremely robust and tiny, and the fact that they require no battery makes them attractive from an environmental standpoint. RF tags may be embedded in drop balls, darts, or other objects that may be pumped through coiled tubing and into a downhole tool. While the present invention is not limited to use with RF tags for telemetry or drop balls for conveyance, the many advantages of tagged drop balls make them a preferred means of conveying information to actuate downhole valves of the present invention.

Radio Frequency Tag Functionality

RF tags are commercially available with a wide variety of capabilities and features. Simple "Read Only" (RO) tags emit a factory-programmed serial number when interrogated by a reader. A RO tag may be embedded in a drop ball and used to initiate a predetermined response from the reader. By programming the reader to carry out certain tasks based on all or a portion of a tag serial number, the RF tags can be used by the operator at surface to control a downhole tool.

In addition to RO tags, "Read/Write" (RW) tags are also available for use in internal telemetry for controlling operations of downhole tools and equipment of wells. These RW tags have a certain amount of memory that can be used to store user-defined data. The memory is typically re-programmable and varies in capacity from a few bits to thousands of bytes. RW tags offer several advantages over RO tags. For example, an operator may use a RW tag to send a command sequence to a tool. A single RW ball may be programmed to, for example, request both a temperature and a pressure measurement at specified intervals. The requested data may then be sent to the surface by another form of telemetry, such as an encoded pressure pulse sequence.

Furthermore, depending on the amount of memory available, the RW tag may effectively be used to re-program the downhole tool. By storing conditional commands to tag memory, such as "If . . . Then" statements and "For . . . While" loops, relatively complicated instruction sets may be downloaded to the tool and carried out.

Applications

From the standpoint of internal telemetry for downhole tool actuation, once the operator of a well has the ability to send information and instructions from the surface to one or more downhole tools, many new actions become possible. By giving a tool instructions and allowing it to respond locally, the difficulties associated with remote tool manipulation are significantly minimized. Furthermore, by using internal telemetry to communicate with downhole tools, critical actions can be carried out more safely and more reliably.

Tool Valves

A reliable downhole valve according to the present invention is required in order to utilize internal telemetry with tagged drop balls for applications where the flow in the tubing must be channeled correctly. The valve must be capable of holding and releasing pressure from above and below, as dictated by the tool and the application. Also, the valve must be operated (e.g. shifted) by the tool itself, not by a pressure differential or tubing movement initiated from the surface. Consequently, the tool string requires a "Printed Circuit Board" (PCB) to control the motor that operates the valve, as well as battery power for operation of the motor.

Various types of valves, such as spool valves, are used today to direct an inlet flow to one or more of several outlets. However, these valves typically require linear motion to operate, which can be difficult to manage downhole due to the opposing forces from high pressure differentials. Furthermore, these valves also typically shift a sealing element, such as an o-ring, which makes them sensitive to debris, such as particulates that are inherent in the well fluid being controlled. Another challenge with using conventional valves is the limited space available in a typical downhole well tool, especially if multiple outlet ports are required.

The tool knowledge for well condition responsive valve actuation is programmed in a downhole microcomputer. When the microcomputer receives a command from a telemetry element, it compares the real time pressures and temperatures measured from the sensors to the programmed tool knowledge, manipulates the valve system according to the program of the microcomputer, and then actuates the tool for sending associated pressure pulses to inform the surface or changes the tool performance downhole without sending a signal uphole.

Indexing Valve

Referring now to FIGS. 2, 2A, 2B, and 2C, a downhole valve according to the present invention may take the form of a motor operated indexing valve, shown generally at 36. The indexing valve has a valve housing 38 which defines a valve cavity or chamber 40 and an inlet passage 41 in communication with the valve chamber 40. The valve housing 38 also defines a motor chamber 42 having a rotary electric motor 44 and a battery 106 located therein. The motor 44 is provided with an output shaft 46 having a drive gear 48 that is disposed in driving relation with a driven gear 50 of an indexer shaft 52 extending from an indexer 54. The axis of rotation 53 of the indexer shaft 52 is preferably concentric with the longitudinal axis of the tool, though such is not required. Though only two gears 48 and 50 are shown to comprise a gear train from the motor 44 to an indexer 54, it should be borne in mind that the gear train may comprise a number of interengaging gears and gear shafts to permit the motor to impart rotary movment at a desired range of motor force for controlled rotation of the indexer 54.

As shown in FIGS. 2 and 2A–2C, the valve housing 38 defines a valve seat surface 56 which may have an essentially planar configuration and which is intersected by outlet passages 58, 60, 62, and 64. The intersection of the outlet passages with the valve seat surface is defined by valve seats, which may be external seats as shown at 66 or internal seats as shown at 68. Valve elements shown at 70, 71 and 72, urged by springs shown at 74 and 76, are normally seated in sealing relation with the internal and external valve seats. To open selected outlet valves, the indexer 54 is provided with a cam element 78 which, at certain rotary positions of the rotary indexer 54, will engage one or more of the outlet valve elements or balls, thus unseating the valve element and permitting flow of fluid from the inlet passage 41 and valve chamber 40 into the outlet passage. Thus, the indexing valve 36 is operated to cause pressure communication to selected inlet and outlet passages simply by rotary indexing movement of the indexer 54 by the rotary motor 44.

The motorized indexing valve 36 of FIGS. 2 and 2A–2C is compact enough to operate in a downhole tool. Also, the indexer 54 is shifted with rotation, not by linear movement, thereby eliminating the need for a pressure-balanced indexer 54. The indexing valve 36 has two main features which are exemplified by FIG. 2A. The first main feature of the indexing valve mechanism is a ball-spring type valve. The springs impose a force on each of the ball type valve elements so that, when the valve ball passes over an outlet port in the chassis, it will be popped into the respective port and will seat on the external seat that is defined by the port. If the indexer 54 is held in this position, the valve ball will remain seated in the port due to the spring force acting on it. This type of valve is commonly referred to as a poppet, check, or one-way valve. It will hold pressure (and allow flow) from one direction only; in this case it will prevent flow from the inlet side of the port to the outlet side. If the indexer 54 is rotated so that the valve ball is unseated, fluid flow will be permitted across the respective port and the pressure that is controlled by the indexing valve mechanism will be relieved and equalized. It should be noted that the spring elements, though shown as coil type compression springs, are intended only to symbolize a spring-like effect that may be accomplished by a metal compression spring, or a non-metallic elastic material, such as an elastomer. It should also be noted that, although valve elements 70–72 are shown that completely block flow through a port, other forms of valve elements that substantially restrict, but do not completely block, flow through a port are within the scope of the invention.

The second main feature of the indexing valve 36 is a cam-like protrusion 78 that is a rigid part of the indexer 54. The cam 78 serves to unseat a ball-spring valve in the chassis that is designed to prevent flow from the outlet passage side 62 of the port to the inlet side, which is defined by the inlet passage 41 and the valve cavity or chamber 40. Therefore, if the cam 78 is acting on the ball 72, the pressure across this port will be equalized and fluid will flow freely in both directions. If the indexer 54 is in a such a position that the cam 78 does not act on the ball 72, the ball 72 will be seated by the spring force and will have sealing engagement with the port. When this happens, the pressure in the corresponding outlet will always be equal to or greater than the pressure on the inlet side.

Figure 2:
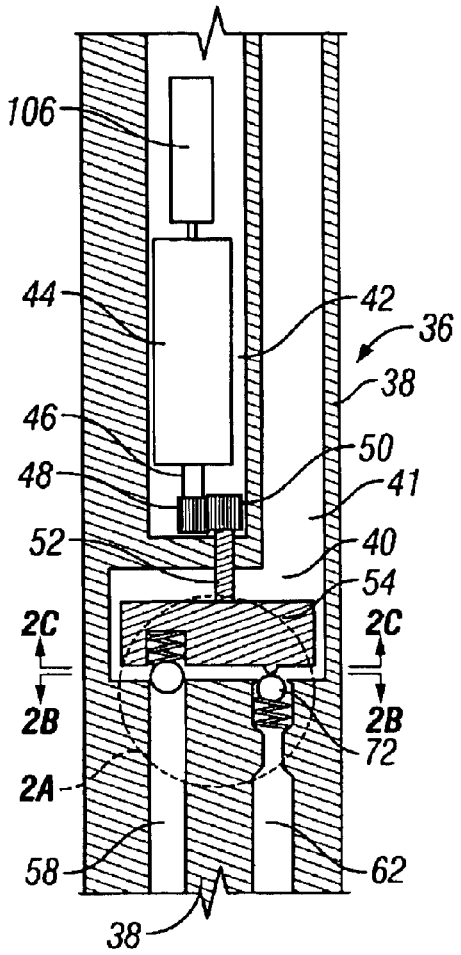
Figure 2A:
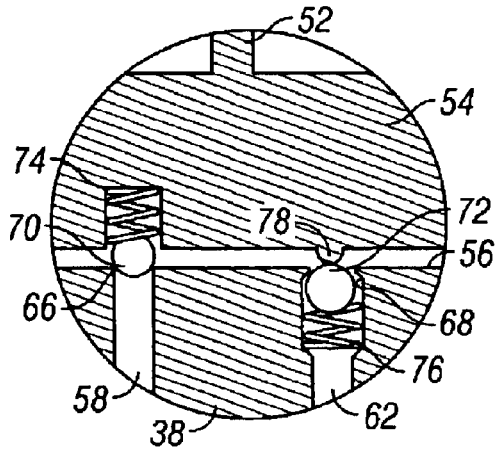
Figure 2B:
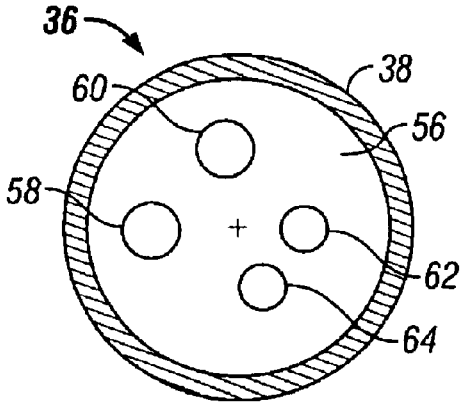
Figure 2C:
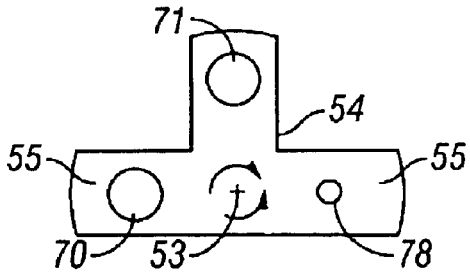

The transverse sectional view of FIG. 2B shows that multiple outlets, for example 58, 60, 62, and 64, may be built into the valve chassis 38. These outlets may be designed, in conjunction with the indexer 54, to hold pressure from above or below. By rotating the indexer 54, an example of which is shown in FIG. 2C, the valves may be opened or closed individually or in different combinations, depending on the desired flow path(s).

An important feature of the indexer 54 is its multiple "arms", or "spokes" 55, with the spaces between the spokes defining flow paths between the valve chamber 40 and the outlet passages 58, 60, 62, 64. This feature allows fluid to flow easily around the arms or spokes 55, which in turn keeps the valve area from becoming clogged with debris. The indexer 54 of FIG. 2C is T-shaped, but it should be borne in mind that the indexer 54 may be Y-shaped, X-shaped, or whatever shape is required to allow for the proper number and placement of the various ball-spring valves and cams. Substantially solid indexers may be employed, assuming that openings are defined that represent flow paths.

It should also be noted that the cams and ball-spring valves need not lie at the same distance from the center of the chassis 38. In other words, the placement of the ball-spring valves and cams could be such that, for example, the indexer 54 could rotate a full 360 degrees and never have a ball-spring valve in the indexer pass over (and possibly unseat) a ball-spring valve in the chassis or housing 38.

Finally, it is important to realize that the valve shown in FIG. 2 is not intended to limit the scope of the invention to a particular arrangement of components. For example, the motor might have been placed coaxially with the indexer, and more or less outlets could have been shown at different positions in the chassis. These variations do not alter the purpose of the indexing valve of the present invention, which is to control the flow of fluid from one inlet, the inlet passage 41 and valve chamber 40 to multiple outlets 58, 60, 62, 64. Furthermore, each ball-spring valve is an example of a mechanism to prevent or substantially restrict fluid flow in one direction while restricting fluid flow in the opposite direction and when one or more spring-urged valve balls are unseated, to permit flow, such as for permitting packer deflation. Though one or more cam projections are shown for unseating the valve balls of the ball-spring valves; other methods used to accomplish this feature are also within the spirit scope of the invention. The cam type valve unseating arrangement that is disclosed herein is but one example of a method for unseating a spring-urged mechanism that only allows one-way flow.

Completions Utilizing Indexing Valves

Current intelligent completions use a set of cables to monitor downhole production from the downhole sensors that have been built into the completion, and to control downhole valve manipulations. The reliability of these cables is always a concern. Using a Type III telemetry element allows the operator to have a wireless two-way communication to monitor downhole production, to perform some downhole valve operations when the tool detects a predetermined situation, and sends back signal pressure pulses to the surface.

For example, as shown diagrammatically in FIG. 3, a well 80 has a well casing 82 extending from the surface S. Though the wellbore may be deviated or oriented substantially horizonally, FIG. 3 is intended simply to show well production from a plurality of zones. Oil is being produced from the first and third zones as shown, but the second or intermediate zone is capable of producing only water and thus should be shut down. Production tubing 83 is located within the casing and is sealed at its lower end to the casing by a packer 85. The well production for each of the zones is equipped with a packer 87 and a valve and auxiliary equipment package 89. The valve and auxiliary equipment package 89 is provided with a power supply 89*a*, such as a battery 106, and includes a valve 89*b* in accordance with the present invention, a telemetry element detector and trigger 89*c* for actuating the valve 89*b* in response to the device (water) sensor 89*d* and controlling flow of fluid into the casing. As shown in FIG. 3, the intermediate valve in the multi-zone well should be closed because of high water production. The operator of the well can pump a Type III telemetry element downhole having a water sensor embedded therein. Since the telemetry element detector will not be able to trigger action until the telemetry element detects a preset water percentage, the only zone that will be closed is the zone with high water production. The other zones of the well remain with their valves open to permit oil production and to ensure minimum water production.

Referring now to FIGS. 4–9, a side pocket mandrel shown generally at 90 may be installed within the production tubing at a location near each production zone of a well. The side pocket type battery mandrel has an internal orienting sleeve 92 and a tool guard 93 which are engaged by a running tool 94 for orienting a kick-over element 96 for insertion of a battery assembly 98 into the side pocket 100, i.e., battery pocket of the mandrel 90. The battery assembly 98 is provided with upper and lower seals 102 and 104 for sealing with upper and lower seal areas 103 and 105 on the inner surface of the battery pocket 100 and thus isolating the battery 106 from the production fluid. The mandrel further includes a valve 107 in the form of an indexing valve as shown in FIGS. 2, 2A, 2B, and 2C, and has a logic tool 109 which is preferably in the form of a microcomputer that is programmed with an appropriate operational logic. The battery assembly 98 also incorporates a latch mechanism 108 that secures the battery assembly within the battery pocket 100. Thus, the battery assembly 98 is deployed in the side pocket of the battery mandrel 90 in a manner similar to installation of a gas lift valve in a gas lift mandrel.

Figure 6:
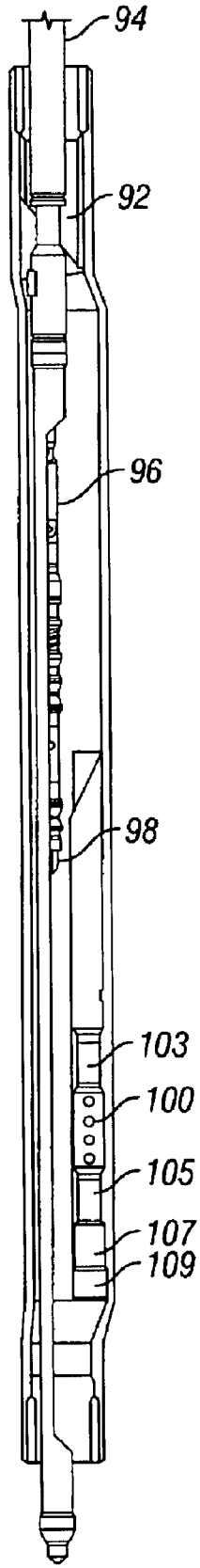
Figure 7:
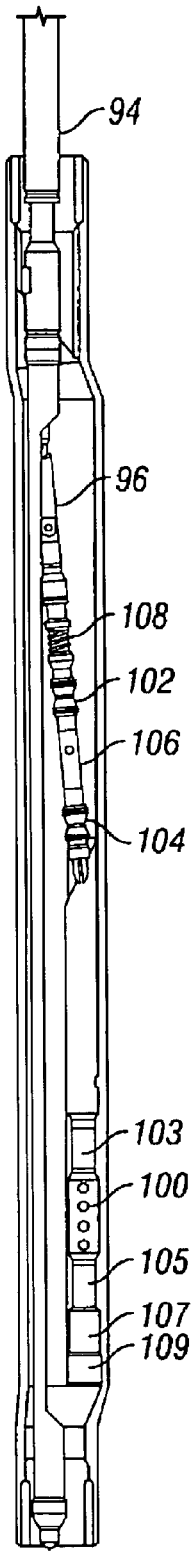
Figure 8:
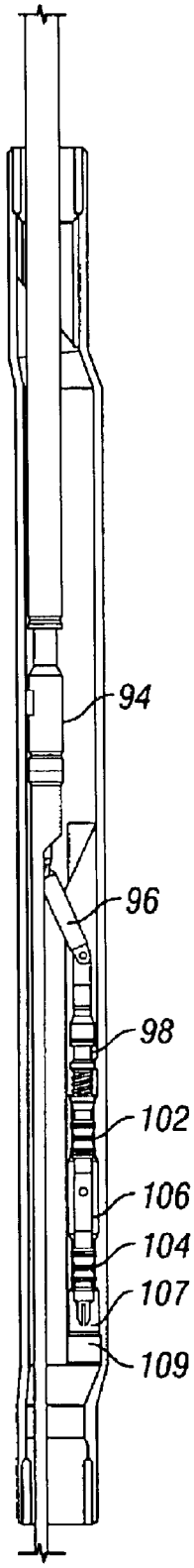
Figure 9:
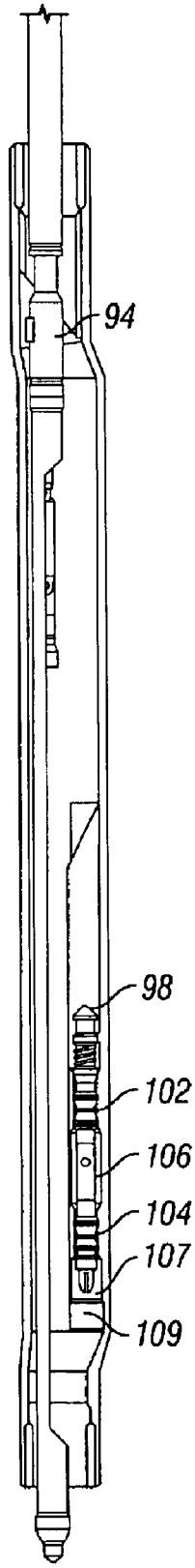

The sequence for battery installation in a side pocket mandrel is shown in FIGS. 6–9. Retrieval of the battery assembly 98 for replacement or recharging is a reversal of this general procedure. As shown in FIG. 6, the orienting sleeve 92 enables the battery 106 to be run selectively. In this case, the battery 106 is being run through an upper battery mandrel to be located within a mandrel set deeper in the completion assembly. As shown in FIG. 7, the orienting sleeve 92 activates the kick-over element 96 to place its battery 106 in a selected battery pocket 100. FIG. 8 shows the battery assembly 98 fully deployed and latched within the battery pocket 100 of the mandrel 90. FIG. 9 illustrates the running tool 94 retracted and being retrieved to the surface, leaving the battery assembly 98 latched within the battery pocket 100 of the mandrel 90.

A downhole valve such as that described may be powered by a replacable battery (replaced using slickline or wireline), a rechargable battery, sterling engine-operated generator, or a turbine-driven generator having a turbine that is actuated by well flow.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A valve comprising:

a housing having a first flow passage therein;

an indexer mounted for rotary movement in said first flow passage;

a valve seat surface in said first flow passage, said valve seat surface having a plurality of ports therein, each of said ports in fluid communication with one of a plurality of second flow passages; and an elastically-loaded first valve element earned by said indexer on said valve seat surface, said first valve element adapted to obstruct at least one of said ports when seated therein.

2. The valve of claim 1, further comprising an elastically-loaded second valve element mounted in at least one of said second flow passages, said second valve element adapted to obstruct said at least one of said second flow passages when urged into contact with said valve seat surface.

3. The valve of claim 2, wherein said indexer comprises a protrusion positioned to engage said second valve element and force said second valve element out of contact with said valve seat surface.

4. The valve of claim 2, wherein said first and second valve elements are spring-loaded balls.

5. The valve of claim 2, wherein said valve seat surface is circular in shape and said first and second ports are located at different distances from the center of said valve seat surface.

6. The valve of claim 1, further comprising a rotary power source in driving relation with said indexer.

7. The valve of claim 6, wherein said rotary power source is an electric motor.

8. The valve of claim 7, further comprising a battery electrically connected to said electric motor.

9. The valve of claim 7, wherein said indexer is mounted on a shaft in driven relation with said electric motor.

10. The valve of claim 9, further comprising a gear train connecting said shaft and said electric motor.

11. A valve comprising:

a housing having a first flow passage therein;

an indexer, comprising a rigid protrusion, mounted for rotary movement in said first flow passage;

a valve seat surface in said first flow passage, said valve seat surface having a port therein, said port in fluid communication with a second flow passage; and an elastically-loaded valve element mounted in said second flow passage, said valve element adapted to obstruct said second flow passage when urged into contact with said valve seat surface; and wherein, said valve element is adapted to a) obstruct said second flow passage when said protrusion is not aligned with said port, and b) permit fluid flow between said first and second flow passages through said port when said protrusion is aligned with said port.

12. The valve of claim 11, further comprising a rotary power source in driving relation with said indexer.

13. The valve of claim 12, wherein said rotary power source is an electric motor.

14. The valve of claim 13, further comprising a battery electrically connected to said electric motor.

15. A valve comprising:

a housing having a first flow passage therein;

an indexer mounted for rotary movement in said first flow passage;

a valve seat surface in said first flow passage, said valve seat surface having a plurality of ports therein, each of said ports in fluid communication with one of a plurality of second flow passages; and an elastically-loaded valve element mounted in at least one of said second flow passages, said valve element adapted to obstruct said at least one of said second flow passages when urged into contact with said valve seat surface; and wherein said indexer comprises a protrusion positioned to engage said valve element and force said valve element out of contact with said valve seat surface.

16. A downhole valve system for wells comprising:

a tubing string extending from the surface of the earth to a desired depth within a well and defining a conveyance passage;

a telemetry data detector adapted for positioning at a selected depth within the well and having a telemetry passage in communication with said conveyance passage;

a microcomputer coupled with said telemetry data detector said programmed for processing telemetry data and providing valve control signals;

at least one telemetry element of a dimension for passing through said conveyance passage and having an identification code recognizable by said telemetry data detector for processing by said microcomputer for causing said microcomputer to communicate control signals to a downhole valve for operation thereof responsive to said identification code; and a downhole valve adapted for positioning at a selected depth within the well, said valve comprising:

a first flow passage therein;

an indexer, comprising a rigid protrusion, mounted for rotary movement in said first flow passage;

a valve seat surface in said first flow passage, said valve seat surface having a first port therein, said first port in fluid communication with a second flow passage;

an elastically-loaded first valve element carried by said indexer on said valve seat surface, wherein said first valve element obstructs flow through said first port between said first and second flow passages when said rigid protrusion is not aligned with said first valve element; and an actuator in driving relation with said indexer.

17. The downhole valve system of claim 16, wherein said valve seat surface has a second port therein, said second part in fluid communication with a third flow passage; and further comprising an elastically-loaded second valve element mounted in said third flow passage, said second valve element adapted to obstruct said third flow passage when urged into contact with said valve seat surface.

18. The downhole valve system of claim 17, wherein said indexer comprises a protrusion positioned to engage said second valve element and force said second valve element out of contact with said valve seat surface.

19. The downhole valve system of claim 16, further comprising a side pocket mandrel, and wherein said valve is mounted in said side pocket mandrel.

20. A downhole valve system for wells comprising:

a tubing string extending from the surface of the earth to a desired depth within a well and defining a conveyance passage;

a telemetry data detector adapted for positioning at a selected depth within the well and having a telemetry passage in communication with said conveyance passage;

a microcomputer coupled with said telemetry data detector and programmed for processing telemetry data and providing valve control signals;

at least one telemetry element of a dimension for passing through said conveyance passage and having an identification code recognizable by said telemetry data detector for processing by said microcomputer for causing said microcomputer to communicate control signals to a downhole valve for operation thereof responsive to said identification code; and a downhole valve adapted for positioning at a selected depth within the well, said valve comprising:

a first flow passage therein;

an indexer, comprising a rigid protrusion, mounted for rotary movement in said first flow passage;

a valve seat surface in said first flow passage, said valve scat surface baying a port therein, said port in fluid communication with a second flow passage;

an elastically-loaded valve element mounted in said second flow passage, said valve element adapted to obstruct said second flow passage when urged into contact with said valve seat surface; and an actuator in driving relation with said indexer; and wherein said valve element is adapted to a) obstruct said second flow passage with said protrusion is not aligned with said port, and b) permit fluid flow between said first and second flow passages through said port when said protrusion is aligned with said poll.

21. The downhole valve system of claim 20, further comprising a side pocket mandrel, and wherein said downhole valve is mounted an said side pocket mandrel.

* * * * *